US009470367B2

(12) United States Patent
Hyde et al.

(10) Patent No.: US 9,470,367 B2
(45) Date of Patent: Oct. 18, 2016

(54) SYSTEMS AND METHODS FOR FLUID CONTAINMENT

(71) Applicant: Elwha LLC, Bellevue, WA (US)

(72) Inventors: Roderick A. Hyde, Redmond, WA (US); Jordin T. Kare, Seattle, WA (US); Lowell L. Wood, Jr., Bellevue, WA (US)

(73) Assignee: Elwha LLC, Bellevue, WA (US)

( * ) Notice: Subject to any disclaimer, the term of this patent is extended or adjusted under 35 U.S.C. 154(b) by 341 days.

(21) Appl. No.: 14/054,605

(22) Filed: Oct. 15, 2013

(65) Prior Publication Data

US 2015/0102036 A1 Apr. 16, 2015

(51) Int. Cl.

| | |
|---|---|
| ***F17C 1/00*** | (2006.01) |
| ***F17C 3/00*** | (2006.01) |
| ***F17C 13/00*** | (2006.01) |
| ***F17C 13/02*** | (2006.01) |

(52) U.S. Cl.

CPC ..... *F17C 3/00* (2013.01); *F17C 13/004* (2013.01); *F17C 13/026* (2013.01); *F17C 2203/0602* (2013.01); *F17C 2203/068* (2013.01); *F17C 2203/0634* (2013.01)

(58) Field of Classification Search

CPC ..... E02B 15/02; B63B 2231/76; B63B 2231/64; C04B 40/0096; B29D 22/003; B29D 99/0017

USPC ..... 220/560.04

See application file for complete search history.

(56) References Cited

U.S. PATENT DOCUMENTS

| | | | | |
|---|---|---|---|---|
| 3,750,412 | A * | 8/1973 | Fitch | B63B 35/086 405/217 |
| 3,826,399 | A * | 7/1974 | Noma | F17C 3/025 220/586 |
| 4,373,836 | A * | 2/1983 | Cox | E02B 17/028 405/195.1 |
| 4,431,346 | A * | 2/1984 | Husebye | E02D 23/00 405/203 |
| 2010/0136324 | A1* | 6/2010 | Ohno | B29B 7/484 428/326 |

OTHER PUBLICATIONS

Gary Johnson, "icecrete", a substiture for concrete as a building material on other (colder) worlds, Mar. 11, 2015.*

* cited by examiner

*Primary Examiner* — Shawn M Braden
(74) *Attorney, Agent, or Firm* — Foley & Lardner LLP

(57) ABSTRACT

A storage container includes a wall structure defining an interior, where the interior is configured to contain a fluid. A portion of the wall structure is formed by a composite material. The composite material includes frozen water and a fibrous additive.

35 Claims, 6 Drawing Sheets

SYSTEMS AND METHODS FOR FLUID CONTAINMENT

BACKGROUND

Certain materials that are a gas at standard temperature and pressure, such as natural gas, may often be stored and transported in a liquid rather than gaseous state, due to the substantial decrease in volume between the gaseous and liquid states, permitting a container having a given volume to hold substantially more of the material in a liquid state than in a gaseous state. Various embodiments herein relate to structures usable to store fluids in a liquid state (e.g., liquefied gases, etc.).

SUMMARY

One embodiment relates to a storage container comprising a wall structure defining an interior, the interior configured to contain a fluid; wherein a portion of the wall structure is formed by a composite material, the composite material comprising frozen water and a fibrous additive.

Another embodiment relates to a containment system for containing a liquid, the containment system comprising a container defining an interior and comprising a wall structure having a composite layer, the composite layer comprising a composite material of frozen water and a fibrous additive, the interior configured to contain the liquid; and a control system coupled to the container and the wall structure, the control system configured to monitor a condition of the container.

Another embodiment relates to a container for containing a liquid, the container comprising a bottom; a top; and a sidewall extending from the bottom to the top; wherein at least one of the bottom, the top, and the sidewall includes a wall structure comprising: an inner layer having an inner surface configured to face the liquid; an outer layer having an outer surface configured to face away from the liquid; and a composite layer comprising a composite material provided between the inner layer and the outer layer, the composite material comprising a frozen liquid and a fibrous additive dispersed throughout the frozen liquid.

Another embodiment relates to a method of making a wall structure for a container, the container configured to contain a liquid, the method comprising providing a composite fluid; providing a wall structure defining a cavity; pouring the composite fluid into the cavity; and freezing the composite fluid within the cavity to form a composite layer within the wall structure.

Another embodiment relates to a method of making a substructure of a wall structure for a container, the container configured to contain a liquid, the method comprising providing a composite fluid; providing a mold defining a cavity; pouring the composite fluid into the cavity; freezing the composite fluid within the cavity to form a substructure comprising the composite layer and at least a portion of the mold; and moving the substructure into a desired position to form part of the wall structure.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
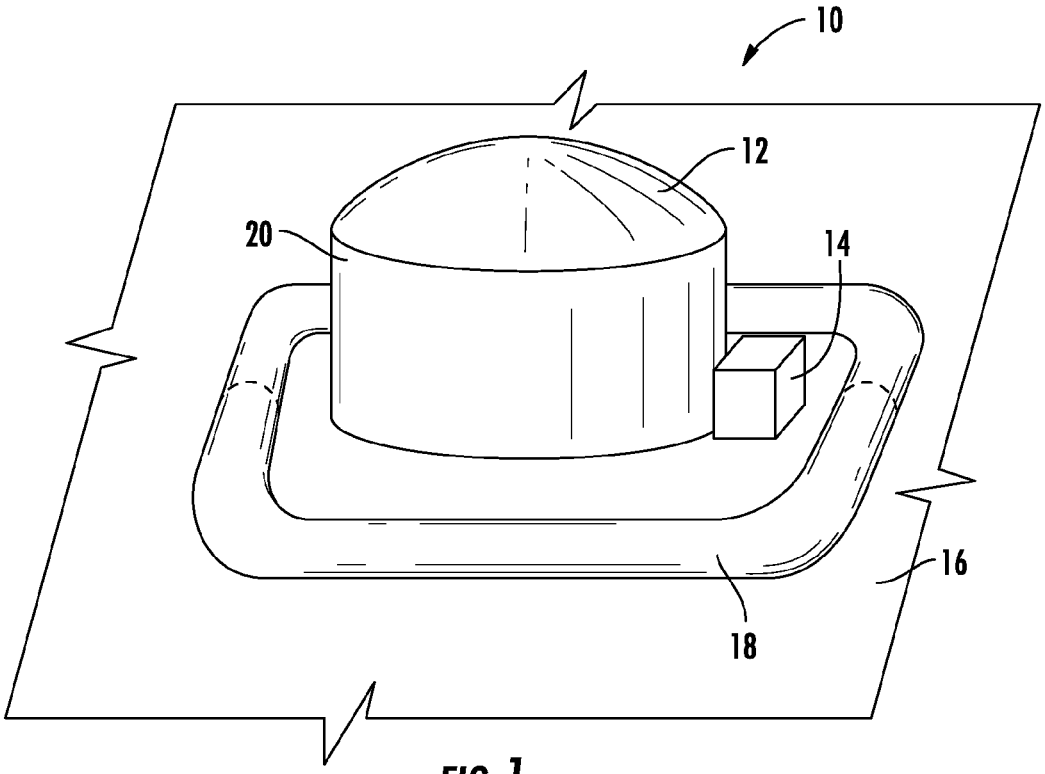
FIG. 1 is a schematic representation of a fluid containment system according to one embodiment.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

Referring to the figures generally, various embodiments disclosed herein relate to storage systems for fluids such as, but not limited to, liquefied natural gas (LNG), etc. More specifically, the present disclosure relates to containment systems that incorporate composite materials (e.g., mixtures of frozen water and one or more fibrous materials or other additives) into containment structures (e.g., LNG storage tanks, etc.) used to contain fluids such as LNG. In some embodiments the composite material can be a mixture of ice and a fibrous additive. The fibrous additive can increase the mechanical strength and reduce the thermal conductivity of the material relative to ordinary ice. According to various alternative embodiments, the fluid may be or include liquid methane, liquid nitrogen, liquid oxygen, liquid propane, and any of a number of other suitable fluids.

Large-volume gas supplies (e.g., natural gas reservoirs, etc.) are often located remotely from industrial/highly populated areas that typically consume large amounts of such products. As such, it is often necessary to store the gas and/or transport the gas over relatively long distances. Because fluids occupy less volume in a liquid, rather than gaseous, state, it is often more practical to liquefy the gaseous material, store and/or transport the material in a liquid state, and then regasify the liquid into a gaseous state for further distribution and/or use. For example, LNG takes up approximately $1/600^{th}$ of the volume of natural gas. In order to convert natural gas to LNG, the natural gas is purified (e.g., to remove substances such as impurities, etc.) and cooled to a temperature of approximately −260 degrees Fahrenheit (F), or −162 degrees Celsius (C) (corresponding generally to the boiling point of LNG at atmospheric pressure). This cooling may be done at or close to atmospheric pressure, or at any other suitable pressure. In the liquid state, the LNG or other liquid is stored in storage tanks, or containment systems.

The containment systems and storage tanks disclosed herein may take various forms. For example, the tanks may be above-ground tanks (i.e., such that the tank is entirely above the ground), in-ground tanks (i.e., such that a portion of the tank is below ground level), or below-ground tanks (i.e., such that the tank is entirely below ground). Furthermore, the containment systems may be single containment, double containment, or full containment. Further yet, various tank designs may utilize an inner membrane, liner, or similar layer that is structurally supported by one or more outer layers of concrete, metal, etc.

A single containment system generally includes a primary tank used to contain a liquid such as LNG, and an earthen dike or similar secondary structure surrounding the primary tank. A single containment tank can include, for example, an inner layer or membrane, an outer layer or skin, and an intermediate layer of insulation and/or other materials disposed between the inner layer and the outer layer. The earthen dike serves as a secondary containment system to contain the LNG in the case of a leak in the primary tank.

A double containment system generally includes a primary tank, and a secondary tank or structure surrounding the primary tank. The primary tank may be similar in design to that used in the single containment system. The secondary tank can be, for example, a metal or concrete structure intended to contain the LNG in the case of a leak in the primary tank. The secondary structure can be open-topped, such that the release of vaporized LNG is not controlled by the secondary structure.

Full containment systems generally include a primary tank intended to contain the LNG, and an outer secondary tank or structure surrounding the primary structure. The primary tank may be similar in design to those used in the single and double containment systems. The secondary structure of a full containment system is intended to contain both the LNG and LNG vapors in the case of a leak of the primary tank. The secondary structure can also provide for a controlled release of LNG and/or LNG vapors. The secondary structure can be a concrete structure including a concrete top, roof, or similar structure.

Referring now to FIG. 1, storage system 10 (e.g., a single, double, or full containment system, an LNG storage system, etc.) is shown according to one embodiment. System 10 includes storage container 12 (e.g., a tank, etc.) and a control system 14 (e.g., a monitoring/maintenance/control system, etc.). As discussed in greater detail below, control system 14 controls the operation of container 12. Container 12 includes one or more wall structures 20 (e.g., bottom, sidewalls, top, bulkhead, etc.) that collectively define an interior 21. Container 12 is configured to store fluid, typically in the form of a liquid. In some embodiments, container 12 is configured to store liquids in a cryogenic environment (e.g., at temperatures at or below −150 degrees C., etc.). According to various other embodiments, container 12 can be configured to operate in a wide range of other temperatures.

Figure 2:
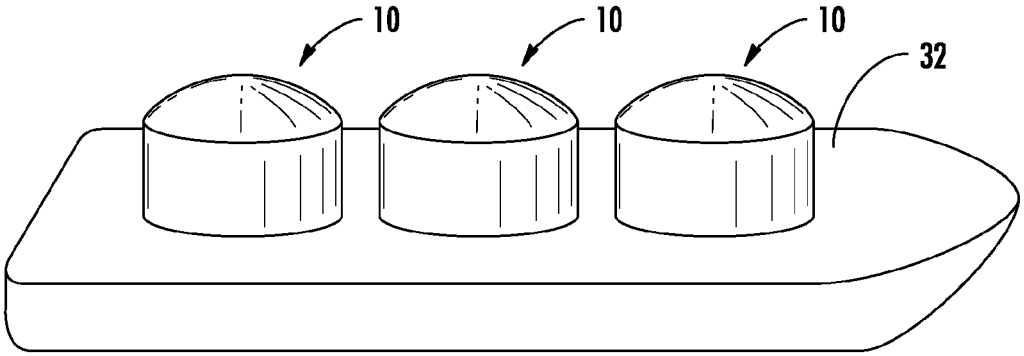
FIG. 2 is a schematic representation of a fluid containment system incorporated into a vessel according to another embodiment.

Referring to FIGS. 1-2, system 10 and container 12 can be used in a variety of environments. For example, in some embodiments, container 12 is a structure built on land and optionally surrounded by an earthen dike 18 or similar structure (typically used in the case of single containment systems). In other embodiments, system 10 is integrated into a vehicle, shown in FIG. 2 to be a carrier 32 (e.g., a ship, tanker, vessel, etc.) configured to transport liquid materials across seas, oceans, etc. According to alternative embodiments, other vehicles, such as train cars, tanker trucks, etc., may be used. Control system 14 can be configured to direct a portion of the LNG vapor from the LNG containers to one or more engines, etc. to help power a carrier, etc.

Figure 3:
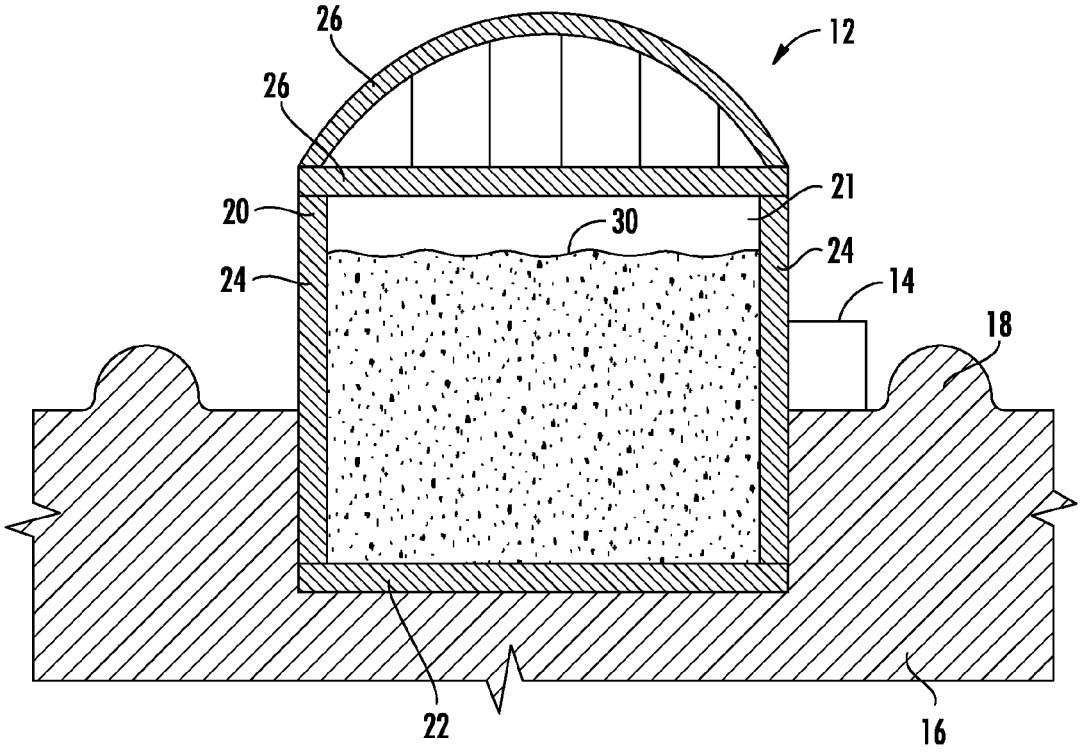
FIG. 3 is a cross-sectional view of the containment system of FIG. 1 according to one embodiment.

Referring now to FIG. 3, according to one embodiment, wall structures 20 of container 12 include a bottom wall 22, one or more sidewalls 24, and a top wall, or roof structure, 26. Collectively, bottom wall 22, sidewalls 24, and top wall 26 define interior 21, within which a liquid 30 is contained for storage and/or transportation. As shown in FIGS. 1-3, container 12 can take the form of a generally cylindrical lower portion with a spherical or domed upper portion. According to various alternative embodiments, container 12 can have a variety of other shapes and sizes, including, for example, a square, rectangular, or irregularly-shaped lower portion, and a flat, domed, peaked, etc. top or roof structure. Furthermore, container 12 can be sized to hold any appropriate amount of liquid. For example, in some embodiments, container 12 is configured to hold at least 50,000 $m^3$ of liquid, at least 100,000 $m^3$ of liquid, or at least 150,000 $m^3$ of liquid. In various other embodiments, container 12 is configured to hold greater or lesser amounts of liquid. All such configurations of container 12 are to be understood to be within the scope of the present disclosure.

Referring to FIGS. 4-7, wall structures usable with container 12 are shown according to various alternative embodiments. In general, the wall structures shown in FIGS. 4-7 incorporate a composite material into the wall structure. As discussed in greater detail below, the composite material can be a mixture of ice (e.g., frozen water), and one or more additives (e.g., fibrous materials, surfactants, etc.). It should be understood that the wall structures shown and described with respect to FIGS. 4-7 and elsewhere herein can be used in any or all of the wall structures of container 12, including, without limitation, bottom wall 22, sidewalls 24, top wall 26, or any other suitable structure (e.g., bulkheads, etc.). Furthermore, different portions of container 12 can take different wall structures, such that a single container 12 can include more than one of the wall structure configurations illustrated in FIGS. 4-7 and/or elsewhere herein.

Figure 4:
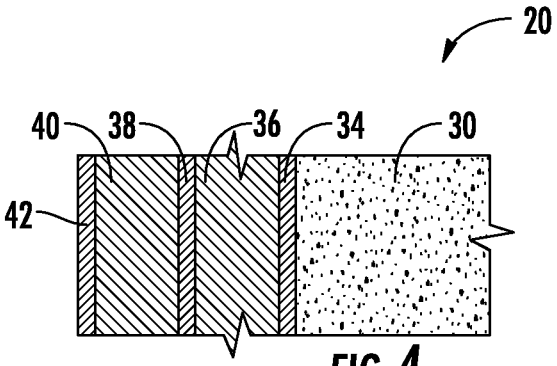
FIG. 4 is a cross sectional view of a wall structure of a containment system according to one embodiment.

Referring now to FIG. 4, wall structure 20 is shown according to one embodiment. Wall structure 20 includes an inner layer 34 (e.g., an inner liner, membrane, member, etc.), a composite layer 36, an intermediate layer 38 (e.g., an intermediate liner, membrane, member, etc.), an insulation layer 40 (e.g., a layer of thermal insulating material, etc.), and an outer layer 42 (e.g., an outer liner, membrane, member, etc.).

Inner layer 34 forms the inner-most layer of wall structure 20, and therefore contacts fluid 30 contained within container 12. In one embodiment, inner layer 34 is or includes a metal, such as 9% nickel steel or another suitable metal (e.g., stainless steel, etc.). Inner layer 34 can provide part or all of the structural support and rigidity for wall structure 20 required to contain fluid 30. Alternatively, inner layer 34 is a relatively thin, metal membrane. In such cases, inner layer 34 may have a material thickness of less than approximately 2 mm (or less than 1 mm, etc. according to alternative embodiments). Inner layer 34 can be formed as a gas- and/or liquid-impermeable layer such that inner layer 34 can contain fluid 30 (e.g., a liquid) and any associated vapors.

Composite layer 36 is provided outside of inner layer 34. According to one embodiment, composite layer 36 is a mixture of ice (e.g., frozen water) and one or more additives (e.g., fibrous materials, etc.). Composite material having a composition including ice and fibrous additives is sometimes referred to as Pykrete. As discussed in detail below, composite layer 36 provides a structural layer that may be more quickly and more cost-efficiently constructed than, for example, a concrete structure having similar strength, thermal insulting, or other characteristics. Furthermore, the typically frozen state of composite layer 36 can take advantage of the necessarily low temperatures required to maintain materials such as natural gas in a liquid state. Further yet, disposal of a composite material may be less expensive than disposing of steel, concrete, or other more typically used materials (e.g., in the case of deconstruction of a container). Composite layer 36 is discussed in greater detail below with respect to FIGS. 8-9.

Referring further to FIG. 4, an intermediate layer 38 is provided to the outside of composite layer 36. Intermediate layer 38 provides support for composite layer 36 and/or provides a liquid impermeable layer to separate composite layer 36 from insulation layer 40 (e.g., should all or a portion of composite layer 36 melt or otherwise be in a liquid state). In some embodiments, intermediate layer 38 is a substantially rigid, metal material. In other embodiments, intermediate layer 38 is flexible and/or made of a variety of polymers, or other non-metal or composite materials.

Insulation layer 40 is provided to the outside of intermediate layer 38, and provides a layer of thermally insulating material that insulates the relatively colder fluid 30 within container 12, along with the typically frozen composite layer 36, from the typically warmer temperatures of the outside environment. Any suitable insulation material can be utilized according to various alternative embodiments. According to one embodiment, insulation layer 40 includes one or more of a loose insulation material (e.g., made from or including Perlite or other suitable material, etc.), a foam insulation material (e.g., a polyurethane foam, etc.), and the like. According to various other embodiments, other suitable insulation materials can be used for insulation layer 40.

Outer layer 42 is provided to the outside of insulation layer 40, and in some embodiments forms the outermost layer of container 12. In further embodiments, additional structure (e.g., additional layers of metal, insulation, concrete, composite materials, etc.) can be provided to the outside of outer layer 42 (e.g., to provide additional structural support, thermal insulation, fluid containment, protection against the environment, etc.). As shown in FIG. 4, outer layer 42 provides an outer skin, or membrane, for wall structure 20. Outer layer 42 can in one embodiment be made of a metal such as 9% nickel steel, carbon steel, etc., while in other embodiments, outer layer 42 can be or include other materials, such as a variety of non-metals (e.g., polymers, etc.) and/or composite materials. In the case of metal or similar materials, outer layer 42 can be a relatively thin layer (e.g., as compared to insulation layer 40 and/or composite layer 36). In other embodiments, outer layer 42 is a relatively thicker layer of material.

Figure 5:
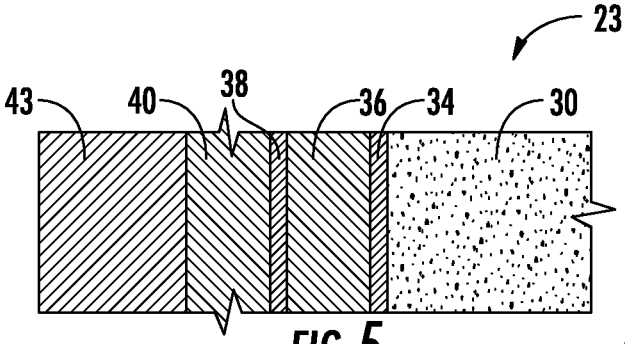
FIG. 5 is a cross sectional view of a wall structure of a containment system according to another embodiment.

Referring to FIG. 5, a wall structure 23 is shown according to another embodiment. Wall structure 23 is similar in many respects to wall structure 20, in that wall structure 23 includes inner layer 34, composite layer 36, intermediate layer 38, and insulation layer 40. Inner layer 34, composite layer 36, intermediate layer 38, and insulation layer 40 can include any of the features discussed above with respect to FIG. 4 and wall structure 20. However, according to one embodiment, rather than a relatively thin outer layer such as outer layer 42 shown in FIG. 4, wall structure 23 includes a relatively thicker outer layer 43.

In one embodiment, outer layer 43 is a concrete layer of material (e.g., reinforced and/or pre-stressed concrete, etc.). Alternatively, outer layer 43 can be or include a variety of metals, polymers, or other types of material. Outer layer 43 can provide structural support for one or more of the other layers (e.g., layers 34, 36, 38, 40) of wall structure 23. In further embodiments, outer layer 43 serves as or is integrated into a secondary containment structure to contain any liquid or vapors that escape from a primary structure. Outer layer 43 is in some embodiments thicker than insulation layer 40 and/or composite layer 36, while in other embodiments, outer layer 43 can have any suitable material thickness.

Figure 6:
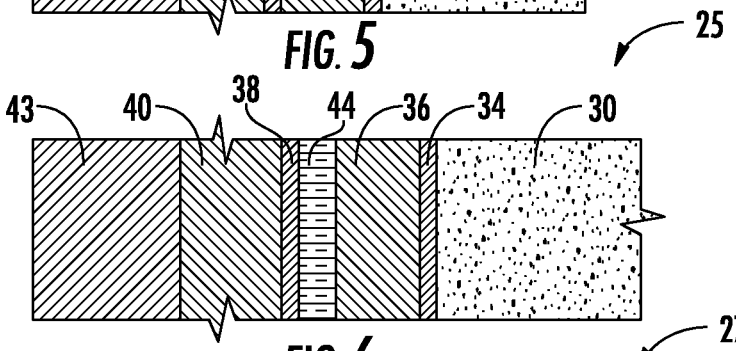
FIG. 6 is a cross sectional view of a wall structure of a containment system according to another embodiment.

Referring now to FIG. 6, a wall structure 25 is shown according to another embodiment. Wall structure 25 is similar in many respects to wall structures 20 and 23, in that wall structure 25 includes inner layer 34, composite layer 36, intermediate layer 38, insulation layer 40, and outer layer 43. Inner layer 34, composite layer 36, intermediate layer 38, insulation layer 40, and outer layer 43 can include any of the features discussed above with respect to FIGS. 4-5 and wall structures 20 and 23. Furthermore, while wall structure 25 is shown as having outer layer 43, in an alternative embodiment, wall structure 25 can use an outer layer such as outer layer 42 shown in FIG. 4.

According to one embodiment, wall structure 25 further includes an additional layer shown in FIG. 6 as a fluid layer 44. As shown in FIG. 6, fluid layer 44 is provided immediately outside composite layer 36, such that fluid layer 44 extends along all of a portion of the outer surface of composite layer 36. In one embodiment, fluid layer 44 is or includes water that stays in a liquid state and is maintained at a pressure relatively higher than the pressure on the opposite side of composite layer 36 (e.g., the pressure within container 12). As such, should any leaks, gaps, etc. form in composite layer 36, the higher pressure of fluid layer 44 will tend to cause fluid to flow toward interior 21 of container 12 (i.e., through composite layer 36). Composite layer 36 can be configured such that as the fluid from fluid layer 44 passes through composite layer 36, the fluid freezes, essentially sealing any leaks, gaps, cracks, etc. that can form in composite layer 36.

According to one embodiment, fluid layer 44 is made up substantially of water and has a freezing point of approximately 32 degrees F./0 degrees C. According to alternative embodiments, one or more additives can be included in fluid layer 44 to, for example, lower the freezing temperature of fluid layer 44 to facilitate maintaining fluid layer 44 in a fluid state while being adjacent composite layer 36, yet permitting the fluid from fluid layer 44 to freeze as it passes through composite layer 36 (and toward the relatively much colder interior 21 of container 12).

Figure 7:
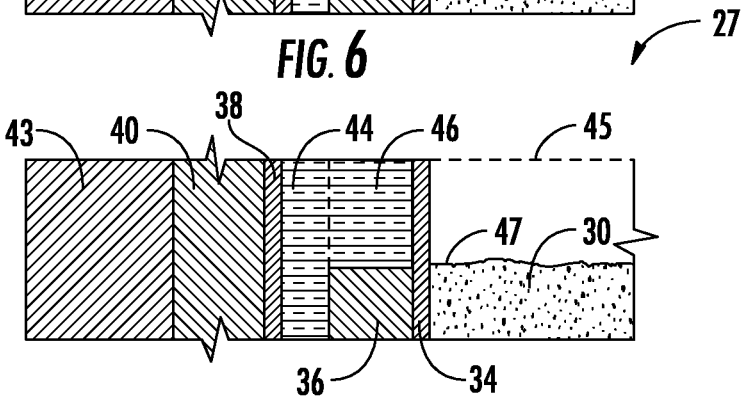
FIG. 7 is a cross sectional view of a wall structure of a containment system according to another embodiment.

Referring to FIG. 7, a wall structure 27 is shown according to another embodiment. Wall structure 27 is similar in many respects to wall structures 20, 23, and 25, in that wall structure 27 includes inner layer 34, composite layer 36, intermediate layer 38, insulation layer 40, and outer layer 43. Inner layer 34, composite layer 36, intermediate layer 38, insulation layer 40, and outer layer 43 may include any of the features discussed above with respect to FIGS. 4-6 and wall structures 20, 23, and 25. Furthermore, while wall structure 27 is shown as having outer layer 43, in an alternative embodiment, wall structure 27 may use an outer layer such as outer layer 42 shown in FIGS. 4-5.

As shown in FIG. 7, in one embodiment, wall structure 27 is configured such that all or a portion of composite layer 36 is in a fluid form. For example, as shown in FIG. 7, the level of fluid 30 within container 12 may drop from level 45 to level 47. As such, an upper portion of composite layer 36 (e.g., generally corresponding heightwise to the removed portion of fluid 30) may melt to form a composite fluid 46, and a lower portion of composite layer 36 (generally corresponding heightwise to the remaining portion of fluid 30) may remain in a frozen and/or substantially frozen state.

Likewise, wall structure 27 can be further configured such that should the level of fluid 30 rise, for example, from level 47 to level 45, composite fluid 46 will refreeze and become part of composite layer 36 (i.e., in a frozen state). The substantially colder temperatures of fluid 30 may in some embodiments be sufficient to freeze composite fluid 46 (e.g., without the use of additional refrigeration components, cooling lines, etc.), while in other embodiments, additional refrigeration components, cooling lines, etc. (see e.g., FIGS. 9 and 12) can be used to facilitate the freezing of composite fluid 46 into the frozen state to form part of composite layer 36.

It should be understood that the various features of wall structures 20, 23, 25, 27 can be used in combination, and all such combinations of features are understood to be within the scope of the present disclosure. For example, outer layer 42 shown in FIG. 4 in connection with wall structure 20 can be used in combination with wall structures 23, 25, and/or 27 (e.g., in place of or in addition to outer layer 43). Similarly, fluid layer 44 shown in FIGS. 6 and 7 in connection with wall structures 25 and 27 can be used in combination with wall structures 20, 23 shown in FIGS. 4 and 5. Further yet, any of wall structures 20, 23, 25, and 27 can utilize the melting/freezing features of composite fluid 46 and composite layer 36 shown in FIG. 7 in connection with wall structure 27.

According to various embodiments, one or more layers can be omitted from wall structures 20, 23, 25, 27 shown in FIGS. 4-7. For example, in some embodiments, one or more of inner layer 34, intermediate layer 38, and outer layers 42, 43 may be omitted from a particular wall structure configuration. Similarly, insulation layer 40 and/or fluid layer 44 can be omitted according to various alternative embodiments. Likewise, wall structures 20, 23, 25, 27 can form or be integrated into a larger wall structure having additional components, layers, etc. For example, additional structural components, membranes, layers of insulation and/or composite material can be used according to various alternative embodiments.

Figure 8:
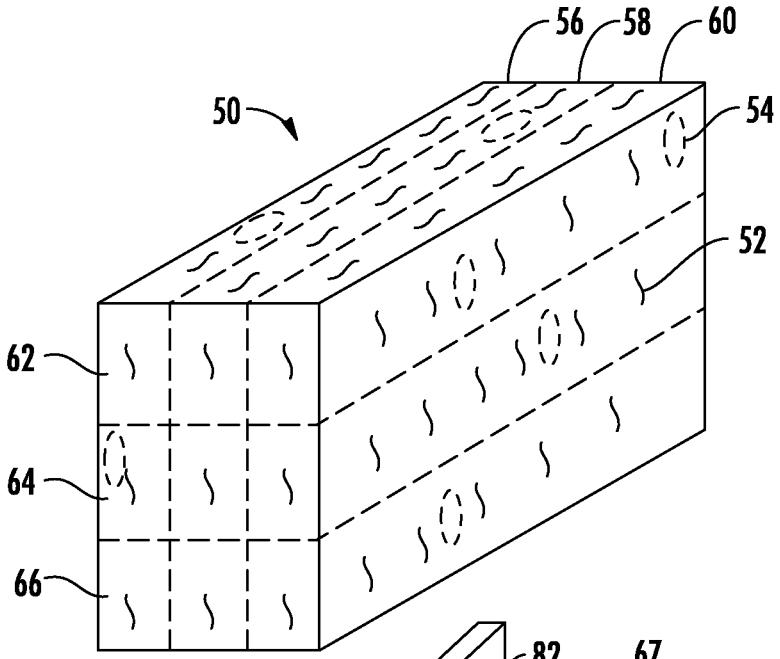
FIG. 8 is a schematic perspective view of a portion of composite material according to one embodiment.

Referring now to FIG. 8, a composite material 50 forming all or a part of composite layer 36 is shown according to one embodiment. As noted above, composite material 50 is made of frozen water having additives 52 added thereto. In one embodiment, additives 52 include fibrous additives, such as paper pulp, saw dust, etc. Additives 52 can further include a number of other types of materials, such as shredded paper or plastic, glass wool (e.g., fiberglass), or any suitable fibrous or other material. Additives 52 are typically small particles (e.g., the size of saw dust particles, etc.) dispersed relatively homogenously throughout composite material 50. In alternative embodiments, additives 52 can be dispersed throughout composite material 50 in a non-homogeneous manner in order to provide differing thermal, mechanical, etc. characteristics to different portions of composite material 50.

Additives 52 increase the strength of composite material 50 (e.g., relative to ice formed of frozen water without additives) and provide a structural component that may be lower in cost and easier to fabricate than more traditional materials, such as concrete, steel, etc. Furthermore, due to the relative cold surrounding temperatures (e.g., the temperature of LNG being at or below −260 degrees F./−160 degrees C.), extensive refrigeration equipment may not be required to keep composite material 50 in a solid (e.g., frozen) state.

The amount of additives 52 used in connection with composite material 50 can vary according to various alternative embodiments. For example, in one embodiment, additives 52 can make up between 5-20% of composite material 50 (by weight), with the remainder of composite material 50 being made up substantially of frozen water. According to alternative embodiments, a lesser or greater amount of additives 52 can be used to modify the structural, thermal, or other properties of composite material 50.

As shown in FIG. 8, composite material 50 in some embodiments includes additional additives 54. Additional additives 54 can include a variety of materials, including, for example, one or more surfactant materials. Surfactants can be included in composite material 50 to act as a dispersing agent such that the surfactants prevent settling and/or clumping of additives 52 and facilitate the homogeneous distribution of additives 52 throughout composite material 50. Surfactants can also be used to alter the mechanical and/or thermal properties of the composite material (e.g., to lower the freezing point of the composite material and/or modify the thermal expansion properties of the composite material to, for example, reduce post-freezing contraction, etc.). Additional additives 54 can further include air- and/or gas-filled elements or components, or composite material 50 can be aerated or otherwise modified to alter the thermal and/or mechanical properties of composite material 50. For example, air- or gas-filled components, or voids in composite material 50, can reduce the thermal conductivity of composite material 50.

Referring further to FIG. 8, composite material 50 can be fabricated so as to define different layers 56, 58, 60 (e.g., generally vertically extending layers of composite material) and/or layers 62, 64, 66 (e.g., generally horizontally extending layers of composite material), where each layer is provided with various characteristics, or indicators, of color, odor, etc., that are usable to indicate a degree of erosion or melting of composite material 50 and/or another condition. For example, different layers of composite material 50 can be made of different colors, such that as the height, thickness, or other dimension of a layer of composite material melts or otherwise erodes or is removed, an indication is provided in the way of a different color. As such, the appearance of a particular color at the surface of composite material 50 provides an indication of a degree of ice erosion, damage, etc. Similarly, different layers can be provided/embedded with odor producing/releasing agents such that as different layers are exposed, different odors are released by composite material 50. According to various alternative embodiments, composite material 50 can be configured to provide other indicators indicative of ice erosion as composite material 50 melts or as interior portions of composite material 50 are otherwise exposed.

As shown in FIG. 8, composite material 50 defines a plurality of layers 56, 58, 60 and 62, 64, 66, where as discussed above, each layer can be provided with an additive that acts as an indicator (e.g., through a visual indication, an odorous indication, etc.) as the interior portions of the composite material 50 are exposed. In other embodiments, rather than or in addition to the various layers shown in FIG. 8, composite material 50 can be otherwise divided into portions that define other-shaped portions of composite material 50 (e.g., cubes, spheres, irregularly shaped portions, etc.), such that as the portions of composite material are exposed, the cube, sphere, etc., provides an indication of the degree of erosion of composite material 50. Furthermore, one or more layers or portions of composite material 50 can be provided as clear ice (e.g., having no additives, or fewer additives than surrounding portions of composite material 50) having sufficient transparency to enable, for example, visual monitoring of the condition of composite material 50.

Figure 9:
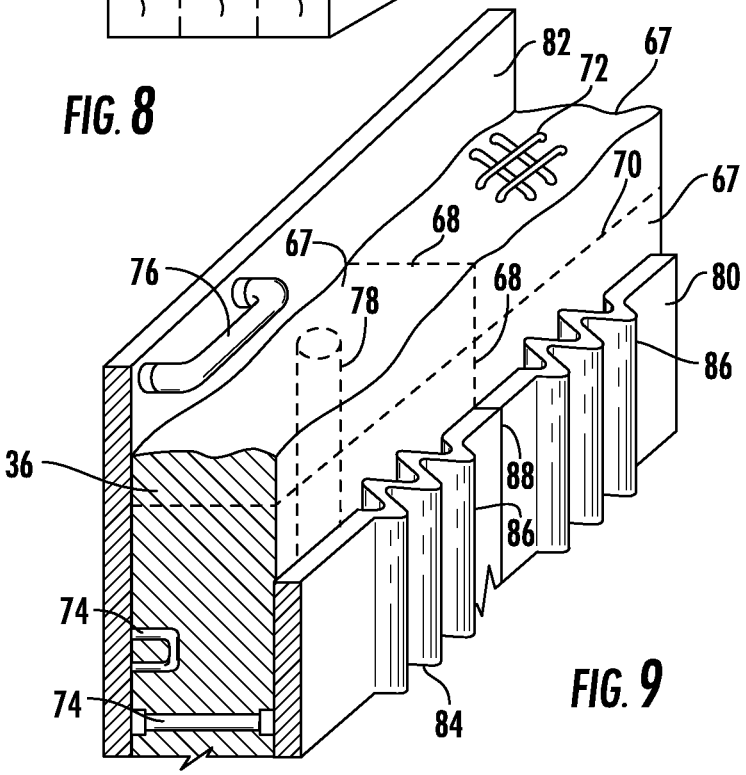
FIG. 9 is a cutaway perspective view of a portion of a wall structure according to one embodiment.

Referring now to FIG. 9, a portion of a wall structure is shown with various components according to another embodiment. As shown in FIG. 9, composite layer 36 is generally provided between an inner wall 80 and an outer wall 82. Inner wall 80 and/or outer wall 82 can be a relatively thin membrane, or skin, that is impermeable to fluids. As such, as discussed in greater detail below, walls 80, 82 can be part of a form into which composite layer 36 is cast. Alternatively, composite layer 36 can be separately cast and subsequently fastened to one or both of walls 80, 82. According to various alternative embodiments, walls 80, 82 can take the form of any of the various layers and wall structures discussed above, for example, with respect to FIGS. 4-7.

Composite layer 36 shown in FIG. 9 can include any of the features discussed above with respect to FIG. 8, in addition to a variety of structural reinforcement/support members, maintenance, monitoring, and/or repair components, and/or other features. For example, in one embodiment, composite layer 36 includes one or more reinforcement or support members 72 at least partially embedded within composite layer 36. Support member 72 can take any of a variety of forms, including rebar, prestressing rods, tension chains or cables, etc. Support members 72 can increase the strength, rigidity, etc. of composite layer 36. In one embodiment, support member 72 can include a tension ring that extends within composite layer 36 and around all of a portion of the container.

Composite layer 36 can further include one or more anchoring elements or fasteners 74 that are usable to secure composite layer 36 to walls 80, 82, or another layer of material forming part of a wall structure (e.g., inner and outer skins, or membranes, etc.). For example, fasteners 74 can be fastened to one or both of walls 80, 82, and be configured such that composite layer 36 freezes about fasteners 74. Fasteners 74 may take any form, including straight, curved, threaded, etc., and can further be or include a heat source and/or a heat element configured to facilitate removal of the fasteners by melting of the surrounding composite material. Other methods (e.g., adhesives, etc.) of securing composite layer 36 to walls 80, 82 or other inner and/or outer layers of materials can be used according to various other embodiments.

According to further embodiments, composite layer 36 includes one or more cooling members or pipes 76 configured to circulate a coolant to facilitate freezing of composite layer 36. For example, referring back to FIG. 7, pipes 76 can be used to melt or refreeze fluid layers 44, 46. Alternatively, pipes 76 can carry a heated fluid such that pipes 76 are usable to melt one or more portions of composite layer 36. The size, shape, number, and configuration of pipes 76 can be varied according to various alternative embodiments. Composite layer 36 can further include one or more monitoring or maintenance members 78 (e.g., hollow or solid tubes, open channels formed in the composite material, optical fibers, etc.) usable to monitor the condition of and/or maintain composite layer 36. For example, members 78 can enable the monitoring of composite layer 36 for leaks, cracks, excessive erosion, etc., and/or enable the delivery of fluids, etc. to composite layer 36.

Referring further to FIG. 9, in some embodiments composite layer 36 is made of a number of individual sections 67 (e.g., portions, castings, etc.) that are separately cast. Sections 67 are defined by vertical joints 68 and/or horizontal joints 70 (e.g., as a result of composite layer 36 being cast in multiple horizontal and/or vertical sections). Sections 67 can be cast in place, for example, during construction of container 12, or alternatively, can be separately cast, either without or without walls 80, 82, and subsequently integrated into one or more wall structures of container 12. In some embodiments, the composite material can be cast around one or more supporting members, reinforcement structures, or other components, including but not limited to any of the components illustrated in FIG. 9. Multiple sections 67 can be joined into a substantially unitary body, for example, by "thermally welding" the sections together (e.g., by melting portions of adjacent sections and permitting the portions to re-freeze together, etc.).

According to one embodiment, walls 80, 82 are relatively thin skins, or membranes, and are impermeable to fluids. Walls 80, 82 can be made of a suitable metal, plastic, combinations thereof, or any other suitable material. One or both of walls 80, 82 can be configured to accommodate differential thermal expansion between walls 80, 82 and composite layer 36. For example, in one embodiment, one or both of walls 80, 82 includes a moveable or expandable portion shown as corrugations 86. Corrugations 86 are formed of bends, waves, etc. in walls 80, 82, and are configured such that walls 80, 82 permit differential expansion of composite layer 36. In other embodiments, other forms of expandable portions can be used.

Figure 10:
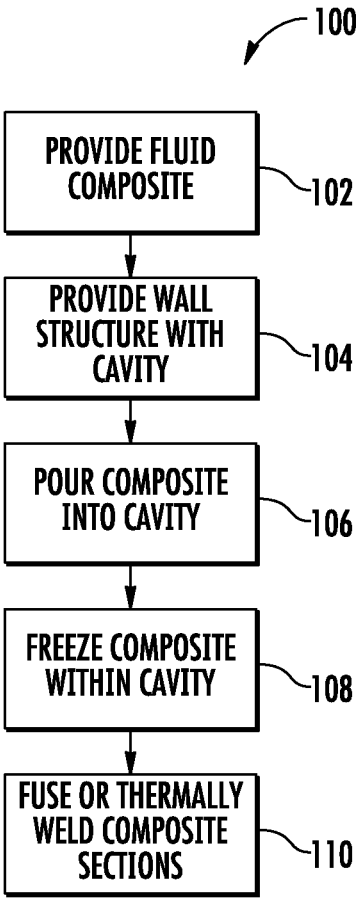
FIG. 10 is a flow chart illustrating a method of fabricating a portion of a wall structure according to one embodiment.

Referring now to FIG. 10, a method 100 of fabricating a portion of a wall structure utilizing a composite material is illustrated according to one embodiment. First, a composite material is provided in liquid form or at least partially liquid form (102). According to one embodiment, the composite material can be a mixture of water and one or more additives, as discussed elsewhere herein. An at least partially constructed wall structure is provided (104), such that the wall structure includes one or more cavities, recesses, etc. that act as molds for casting the composite material. The wall structure can include inner and/or outer membranes, or skins, along with one or more fasteners, supporting members, reinforcement members, etc. (see, e.g., FIG. 9) about which the composite material is cast. The composite material is then poured into the one or more recesses or cavities in the wall structure (106). The composite material can be in a liquid or at least partially liquid state such that it tends to flow around any fasteners, supports, etc. that are positioned within the cavity. Furthermore, as also discussed above, one or more channels, voids, tubular hollow sections, etc., can be provided in the casting cavity. Upon a desired amount of composite material being poured into the cavity, the composite material is cooled (108) such that the composite material freezes/solidifies, or at least partially solidifies, into a solid or semi-solid layer of composite material.

After casting the section of composite material, additional sections of composite material can be subsequently cast using the steps discussed above. For example, in some embodiments, it may be desirable to cast the composite material in multiple horizontal and/or vertical layers, or sections. As such, the separately cast sections are subsequently fused, or thermally welded, together (110). In one embodiment, each section of composite material is fused to adjacent sections prior to additional sections being cast. In other embodiments, multiple sections are cast and then subsequently fused or thermally welded together. The fusion or welding process generally includes locally melting adjacent portions of composite material and then refreezing the composite material to form a solid joint (e.g., joints 68, 70 shown in FIG. 9).

Figure 11:
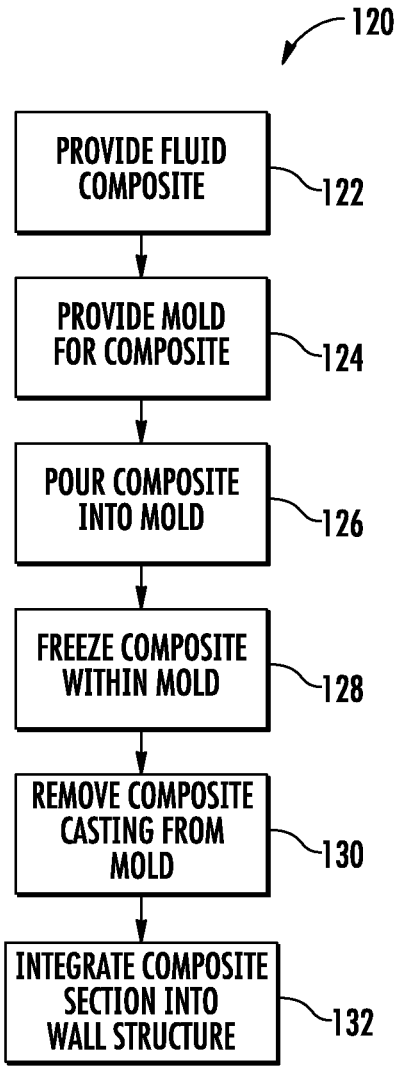
FIG. 11 is a flow chart illustrating a method of fabricating a portion of a wall structure according to another embodiment.

Method 100 illustrated in FIG. 10 provides for casting a composite material into a wall structure, for example, on site during construction of a container such as container 12. According to other embodiments, the composite material can be cast into free-standing and/or transportable structures that can be cast, transported, and subsequently integrated into one or more wall structures of a container such as container 12. For example, referring to FIG. 11, a method 120 for fabricating sections of composite material is shown according to one embodiment. First, a composite material is provided in liquid form or at least partially liquid form (122). According to one embodiment, the composite material is a mixture of water and one or more additives, as discussed elsewhere herein. A mold for casting the composite material is provided (124). The mold can be a reusable mold that is usable to cast multiple sections of composite material. Alternatively, one or more portions of the mold (e.g., one or more membranes, or skins, etc.) can form a part of a resultant wall structure. For example, in one embodiment, the mold used in the casting process can form one or both of an inner membrane and an outer membrane for the composite material that is integrated into a wall structure for a container.

The composite material is then poured into the mold (126), and frozen/solidified (128), or at least partially solidified. In some embodiments, multiple sections are cast sequentially into a single mold. After solidifying the composite material, the section of composite material is removed from the mold (130). As noted earlier, in some embodiments, the mold can form a part of a wall structure, such that the composite material is not removed from the mold, but the mold and composite material collectively form a sub-structure of a wall structure. The composite material and/or associated mold (or a portion thereof) is then integrated into a wall structure (132).

Figure 12:
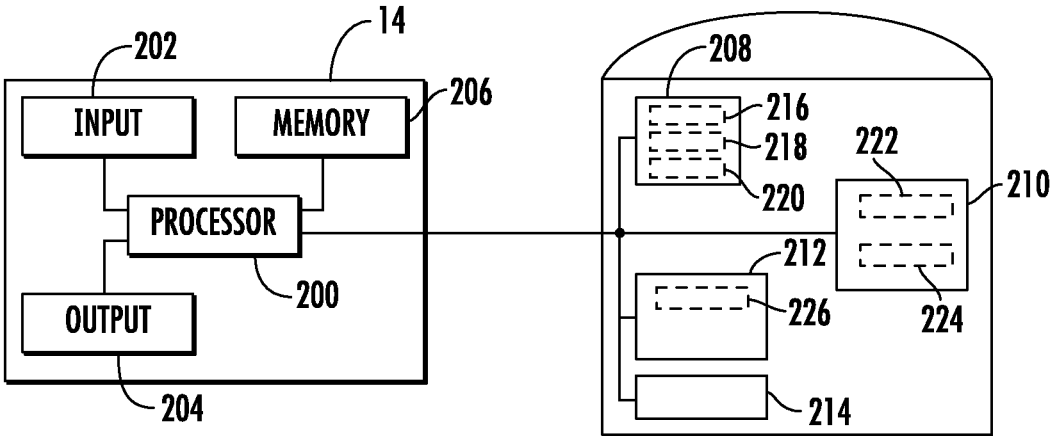
FIG. 12 is a schematic representation of a control system usable with a containment system according to one embodiment.

Referring now to FIG. 12, control system 14 usable in combination with a storage container such as container 12 is shown according to one embodiment. Control system 14 is usable to receive inputs regarding temperature, erosion of the composite layer, fluid levels, and/or other parameters associated with the operation of storage container 12, and to control various heating/cooling systems, fluid delivery systems, etc., based on the monitored inputs. Control system 14 is provided with a computer processor 200 (e.g., one or more processors, servers, etc.) coupled to one or more user input devices 202 (e.g., a keyboard, touchscreen microphone, etc.), one or more user output devices 204 (e.g., a visual output device such as a computer screen, etc., an audible output device, such as an alarm, speaker, etc.), and a computer memory 206 (e.g., a computer database/server, etc.).

Container 12 is provided with a monitoring or sensing system 208, a temperature control system 210, a fluid control system 212, and other systems 214. According to one embodiment, sensing system 208 includes one or more temperature sensors 216, one or more fluid level sensors 218, and one or more visual monitoring components 220, that collectively monitor various conditions of container 12. For example, temperature sensors 216 can measure a temperature of fluid 30 stored within container 12, a temperature of one or more components of a wall structure component, such as composite layer 36, a temperature of a fluid layer such as fluid layer 44 shown in FIG. 6, a temperature of the environment outside of container 12, etc. Fluid level sensors 218 can measure a level of fluid 30 stored within container 12, a level of a fluid layer 44 within one or more wall structures, a level of a composite fluid such as composite fluid 46 shown in FIG. 7, etc. Visual monitoring components 220 can include video cameras, still image cameras, fiber optic components, etc. that capture video, images, etc. of conditions within portions of container 12 (e.g., within the interior of the container, within the wall structures of the container, etc.), such that the images can be viewed by way of, for example, user output device 204 (e.g., a video display, etc.).

Temperature sensors 216, fluid level sensors 218, and visual monitoring components 220 are configured to provide inputs to processor 200. Processor 200, based at least in part on the received inputs, controls the operation of temperature control system 210, fluid control system 212, and other systems 214. Processor 200 can further receive, and control the operation of, various systems based on inputs from user input device 202, data stored in memory 206, and/or other information. For example, processor 200 controls a heating element 222 and/or a cooling element 224 based on one or more detected temperatures within container 12. In one embodiment, heating element 222 and/or cooling element 224 can take the form of pipe 76 shown in FIG. 9, such that composite layer 36 can be heated or cooled based on the current sensed temperature of composite layer 36 or another sensed parameter. Similarly, processor 200 controls a fluid delivery system 226, which can take the form of member 78 shown in FIG. 9, to supply additional fluids (e.g., water, fluid composite, etc.) to one or more locations within a wall structure or other area within container 12 based on, for example, a fluid level within the wall structure, a temperature within the wall structure, etc. Processor 200 can control other systems (e.g., other systems 214) based on various inputs according to various alternative embodiments.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

The present disclosure contemplates methods, systems, and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although the figures may show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. A storage container, comprising:

a wall structure defining an interior, the interior configured to contain a fluid;

wherein a portion of the wall structure includes a composite layer extending along a portion of a height of the wall structure and formed by a composite material, the composite material comprising frozen water and a fibrous additive;

wherein the composite layer includes a plurality of composite sections joined together at a plurality of joints by melting and refreezing adjacent portions of composite sections.

2. The container of claim 1, wherein the fluid includes a liquid having a boiling point below 0 degrees Celsius.

3. The container of claim 1, further comprising a liquid-impermeable membrane that lines a portion of an inner surface of the wall structure.

4. The container of claim 1, further comprising a reinforcing member disposed at least partially within the composite layer.

5. The container of claim 4, wherein the reinforcing member includes a tension ring extending about the interior.

6. The container of claim 1, wherein the composite layer includes a fluid-impermeable membrane coupled to a surface of the composite layer.

7. The container of claim 6, wherein the membrane includes a moveable portion configured to accommodate differential thermal expansion between the composite material and the membrane.

8. The container of claim 6, further comprising a plurality of fasteners, wherein the membrane is coupled to the composite layer by the plurality of fasteners.

9. A storage container, comprising:

a wall structure defining an interior, the interior configured to contain a fluid, wherein a portion of the wall structure includes a composite layer extending along a height of the wall structure and formed by a composite material, the composite material comprising frozen water and a fibrous additive;

a fluid-impermeable membrane coupled to a surface of the composite layer; and a plurality of fasteners, wherein the fluid-impermeable membrane is coupled to the composite layer by the plurality of fasteners;

wherein the plurality of fasteners are configured to locally heat and cool the composite material adjacent the plurality of fasteners.

10. The container of claim 9 wherein the composite layer includes a plurality of composite sections joined together at a plurality of joints.

11. The container of claim 10, wherein the plurality of composite sections are joined together at the plurality of joints by melting and refreezing adjacent portions of composite sections.

12. A containment system for containing a liquid, the containment system comprising:

a container defining an interior and including a wall structure having a composite layer, the composite layer including a composite material of frozen water and a fibrous additive, the interior configured to contain the liquid; and a control system coupled to the container and the wall structure, the control system configured to monitor a condition of the container;

wherein the composite layer includes a plurality of composite sections joined together at a plurality of joints by melting and refreezing adjacent portions of composite sections.

13. The system of claim 12, wherein the composite layer includes a plurality of different layers.

14. The system of claim 13, wherein a portion of the plurality of layers are configured to provide an indication of at least one or melting and erosion of the composite material.

15. The system of claim 14, wherein the indication is a visual indication.

16. The system of claim 15, wherein the visual indication is a color of the composite material.

17. The system of claim 14, wherein the indication is an odorous indication.

18. The system of claim 17, wherein the odorous indication is provided by vaporization of an odorant provided in the composite material.

19. The system of claim 12, wherein the at least one condition includes a temperature of the composite material.

20. The system of claim 19, wherein the control system is configured to control operation of a heating and cooling system for the composite layer based on the temperature of the composite material.

21. The system of claim 20, wherein the heating and cooling system includes at least one temperature control member provided within the composite layer and coupled to the control system, the temperature control member configured to be selectively heated and cooled to heat and cool the composite layer.

22. The system of claim 12, wherein the at least one condition includes erosion of the composite layer.

23. The system of claim 22, wherein the control system is configured to control operation of a fluid delivery system to deliver composite liquid to the composite layer based on erosion of the composite layer.

24. The system of claim 23, wherein the fluid delivery system includes at least one fluid delivery member provided within the composite layer and coupled to the control system, the fluid delivery member configured to selectively provide fluid composite to the composite layer.

25. The system of claim 12, wherein the at least one condition includes a level of the fluid within the container.

26. A container for containing a liquid, the container comprising:

a bottom;

a top; and a sidewall extending from the bottom to the top;

wherein at least one of the bottom, the top, and the sidewall includes a wall structure comprising:

an inner layer having an inner surface configured to face the liquid;

an outer layer having an outer surface configured to face away from the liquid;

a composite layer comprising a composite material provided between the inner layer and the outer layer, the composite material including a frozen liquid and a fibrous additive dispersed throughout the frozen liquid; and a movable portion including a plurality of corrugations extending along the inner layer and configured to expand and contract as the composite layer expands and contracts.

27. The container of claim 26, further comprising a fluid layer provided adjacent the composite layer.

28. The container of claim 27, wherein the fluid layer is provided to the outside of the composite layer.

29. The container of claim 27, wherein the fluid layer has a higher pressure than the liquid within an interior of the container.

30. The container of claim 26, wherein at least a portion of the composite layer is configured to be in a liquid state based on a level of the liquid within an interior of the container.

31. The container of claim 26, wherein at least a portion of the composite layer is configured to change between fluid and solid states based on the level of the fluid within an interior of the container.

32. The container of claim 26, wherein the fibrous additive includes at least one of paper pulp and saw dust.

33. The container of claim 26, wherein the fibrous additive includes at least one of shredded paper, shredded plastic, and glass wool.

34. The container of claim 26, wherein the composite material is between 5 to 20 percent fibrous additive.

35. The container of claim 26, wherein the composite material includes a surfactant configured to disperse the fibrous additive throughout the composite layer.

* * * * *